United States Patent [19]

Meguro et al.

[11] Patent Number: 4,867,910

[45] Date of Patent: Sep. 19, 1989

[54] ELECTRICALLY CONDUCTIVE FERROFLUID COMPOSITION

[75] Inventors: Kenjiro Meguro, Tokyo; Atsushi Yokouchi, Yokohama, both of Japan

[73] Assignee: Nippon Seiko Kabushiki Kaisha, Tokyo, Japan

[21] Appl. No.: 119,652

[22] Filed: Nov. 12, 1987

[30] Foreign Application Priority Data

Nov. 11, 1986 [JP] Japan ..... 268277

[51] Int. Cl.[4] ..... H01B 1/06

[52] U.S. Cl. ..... 252/519; 252/513; 252/521; 252/518; 252/500; 252/62.56; 252/62.57; 252/62.63

[58] Field of Search ..... 252/513, 519, 62.51, 252/500, 62.56, 62.57, 62.63, 521, 518; 524/80, 236

[56] References Cited

U.S. PATENT DOCUMENTS

| | | | |
|---|---|---|---|
| 3,424,698 | 1/1969 | Lupinsky et al. | 252/500 |
| 4,469,624 | 9/1984 | Ueda et al. | 252/513 |
| 4,500,459 | 2/1985 | Hotta et al. | 252/500 |
| 4,556,611 | 12/1985 | Nakayima et al. | 252/519 |
| 4,568,485 | 2/1986 | Jonas et al. | 252/500 |
| 4,568,494 | 2/1986 | Jonas et al. | 252/500 |
| 4,604,229 | 8/1986 | Raj et al. | 252/510 |
| 4,687,596 | 8/1987 | Bordry et al. | 252/513 |
| 4,700,436 | 10/1987 | Moreta | 252/519 |
| 4,734,220 | 3/1988 | Jonas et al. | 252/500 |

*Primary Examiner*—Josephine Barr

*Attorney, Agent, or Firm*—Arnold S. Weintraub; William D. Blackman

[57] ABSTRACT

A ferrofluid composition consists of organic solvent or solvents to be used as liquid carriers, a charge-transfer complex or complexes for imparting electrical conductivity to the composition, fine particles of ferromagnetic material and additives for stably dispersing the aforesaid fine particles of ferromagnetic material into the organic solvent(s). According to this ferrofluid composition electrical conductivity of the fluid is given by the charge-transfer complex, which enhances the electrical conductivity, that is, functions to prevent electrification from occurring. The charge-transfer complex is dissolved, solubilized or dispersed in the carrier either by itself or by the aid of any additives. The ferromagnetic particles act to adsorb the additives and disperse them stably in the carrier and thus contribute to imparting magnetic properties to the carrier.

18 Claims, 1 Drawing Sheet

ELECTRICALLY CONDUCTIVE FERROFLUID COMPOSITION

BACKGROUND OF THE INVENTION

1. Field of the Invention

This invention relates to an electrically conductive ferrofluid composition imparted with a property for preventing electrification from occurring.

2. Prior Art

A ferrofluid or magnetic colloid is a very stable liquid in which fine particles of ferromagnetic materials such as magnetite, ferrite, iron or cobalt are finely dispersed, and the liquid itself has strong apparent magnetic properties.

Accordingly, though it takes a form of liquid, its demeanor can be freely constrained by a magnetic component such as a magnet. Thus, ferrofluids have been widely used as dampening agents, sealing agents in sealing means for magnetic discs or the like. However, when a conventional ferrofluid is used in the sealing means for some magnetic discs or the like, it has been required to provide an additional grounding means so as to remove the electrostatic charge apt to be built-up in the device. In view of this drawback, a proposal has been made to avoid such an undesirable electrostatic charge by imparting electrical conductivity to the ferrofluid itself without providing any particular grounding means. See U.S. Pat. No. 4,604,222.

This U.S. Pat. utilizes a cationic surfactant such as a quartenary ammonium salt in place of an anionic surfactant which is generally used in a ferrofluid. In the U.S. Patent, the cationic surfactant or surfactants are used to stably disperse ferromagnetic particles in a liquid carrier composed of an orgnaic solution such as mineral oil, polyalphaolefin oil or the like.

However, the above mentioned prior art utilizesd the cationic surfactant as an agent for stabilizing the dispersion and at the same time for imparting electrical conductivity. Consequently, the amount of such surfactant to be added is inevitably limited by the density of the ferromagnetic particles, namely, the amount of saturation magnetization, thus it becomes difficult to freely adjust the electrical conductivity.

In addition, a cationic surfactant is low in its thermal stability, as is well known, accordingly, there has been a problem in that the ferrofluid using suc surfactant naturally displays low thermal stability.

SUMMARY OF THE INVENTION

The present invention has been made in view of such drawbacks encountered in the conventional ferrofluid. The present invention provides a ferrofluid composition capable of freely adjusting its electrical conductivity irrespective of the extent of saturation magnetization and having high thermal stability. This is achieved by making the agent for imparting electrical conductivity to be stably dissolved, solubilized or dispersed in the carrier, without making the surfactant, itself, electrically conductive.

The ferrofluid composition according to this invention, comprises an organic solvent or solvents to be used as liquid carriers, a charge-transfer complex for imparting electrical conductivity, fine particles of ferromagnetic material, and additives for stably dispersing said fine particles of ferromagnetic material into the organic solvent(s).

According to the ferrofluid of this invention, electrical conductivity of the fluid is given by the charge-transfer complex. The charge-transfer complex functions to prevent electrification from occurring by being dissolved, solubilized, or dispersed in the carriereither by itself or by any additives. The ferromagnetic particles act to adsorb the additives and disperse them stably in the carrier and, also to impart a magnetic property to the carrier.

DETAILED DESCRIPTION OF THE PREFERRED EMBODIMENTS

Figure 1:
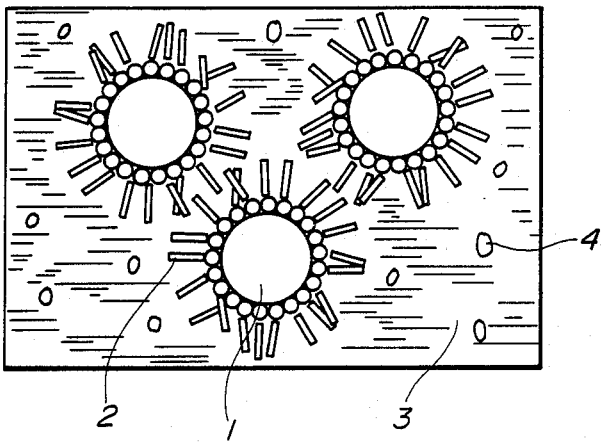

Explanation will be made hereafter, in detail, on the electroconductive ferrofluid of the present invention.

As a carrier or carriers to be used as a dispersant for the ferromagnetic particles and the charge-transfer complex, fluids such as various hydrocarbon fluids, including mineral oils, synthetic oils, ethers, esters, silicone oils or the like can be suitably selected, depending upon the application for which the ferrofluid is intended.

As a sealing agent for a magnetic disc, for example, a poly- α-olefin oil, an alkylnaphthalene oil, a polyphenylether, an alkylpolyphenylether or the like, as well as mixtures thereof, are suitable. The agent for imparting electrical conductivity according to the ferrofluid of the present invention is a charge-transfer complex or complexes, which is a molecular compound or compounds formed between an electron donor D, such as an aromatic compound, a heteroaromatic compound, an amine or the like and an electron acceptor A, such as a 7,7,8,8-tetracyanoquinodimethane (TCNQ) or the like. The electron donor D and electron acceptor A are used to form a couple, for example, as shown in Table 1.

TABLE I

| D | A |
|---|---|
| Violanthrone | Iodine |
| Pyrene | Iodine |
| Pyridazine | Iodine |
| Benzidine | Iodine |
| Tetrathiafulvalene | TCNQ |
| N—methylphenazine | TCNQ |
| Hexamethylene tetraselenofulvalene | TCNQ |
| Tetrathiafulvalene | 2,4,6-tricyanotriazine |

The molar ratio of the electron donor and electron acceptor is preferred to be within a range of 1:0.1 to 1:10.

The amount of charge-transfer complex to be added to the ferrofluid may be up to about 50% by weight ratio to the ferrofluid. By adjusting the amount of addition of the charge-transfer complex or complexes, the aimed electrical resistance of the conductive ferrofluid can be readily adjusted.

As ferromagnetic particles suitable for the present invention, magnetite colloid particles obtained by the conventional wet method can be used. Alternatively, it is possible to use wet magnetite particles such as those obtained by a so-called wet pulverizing method wherein magnetite particles are pulverized by a ball mill in water or an organic solvent.

When the wet pulverizing method is used with an organic solvent, such as hexane, the ferromagnetic particles and a surfactant in an amount sufficiently to stably disperse the particles, on the surface of which a monomolecular layer can be formed, are added and, then, subjected to pulverizing for several hours in a ball mill.

It is also possible to use ferromagnetic particles other than magnetite, for example, ferromagnetic oxides such as manganese ferrite, cobalt ferrite, a complexed ferrite of these ferrites admixed with zinc or nickel, barium ferrite, or ferromagnetic metals such as iron, cobalt, rare earth metals or the like.

Furthermore, it is also possible to use ferromagnetic particles obtained by a dry method other than those obtained by the wet method or wet pulverizing method as mentioned above.

The particle diameter of the ferromagnetic particles of the present invention lies within the range of 20 to 500 Å (angstrom).

A crystal of magnetite, consists of at least several unit cells and each takes a reverse spinnel structure having a lattic constant of 8 Å. Accordingly, the particle diameter must be at least 20 Å.

Speaking of its maximum particle diameter, the value of a parameter λ becomes important, from the viewpoint of stability of the ferrofluid as a suspension wherein ferromagnetic particles are dispersed.

The value λ is expressed by a formula:

$$\lambda = Ms^2V^2/d^3kT$$

wherein,

Ms is the saturation magnetization,

V is the particle volume, d is the particle diameter, k is the Boltzmann constant, and T is the absolute temperature.

Generally, the limit value for preventing agglomeration of the ferromagnetic particles, against both the inter-molecular attractive force and the dipole-dipole magnetic attraction, by means of the repulsion force imparted by the surfactant layer formed on the surface of the particles, is said to be $\lambda = 10^3$.

Assuming for precaution's sake, $\lambda = 10^2$, and saturation magnetization Ms=400 G, then the maximum diameter d obtained from the above formula becomes 500 Å, although the preferable particle diameter is about 100 Å, and in this case $\lambda = 1$, when Ms=400G in the above formula, and there is not fear that the dispersed magnetic particles may precipitate even when they are kept still for a considerably long period of time.

The content of the ferromagnetic fine particles of the present invention, generally, may amount to from about 1 to about 20% by volumetric ratio, but it can be raised further to a very high content of about 70%, where necessary.

In other words, the content of the ferromagnetic fine particles of the ferrofluid of the present invention can be adjusted up to a high level of about 70%, by utilizing an intermediate medium explained later, wherein the ferromagnetic particles are dispersed in a low melting point solvent. By virtue of this, a ferrofluid of very high magnetization can be obtained.

The additives for dispersing the ferromagnetic particles in the organic solvents in a stable manner, according to the present invention, can be selected from the group consisting of, anionic surfactants having at least one polar group such as, a carboxyl group (—COOH), a hydroxyl group (—OH), a sulfone group (—$SO_3H$), an amino group (—$NH_2$), a phosphate ester group (—O-$PO_3H$), or the like as well as mixtures thereof and wherein the anionic surfactant has at least 10 carbon atoms, and nonionic surfactants, e.g., an unsaturated fatty acid such as an oleic acid or a salt thereof, a petroleum sulfonate or the salt thereof, a synthetic sulfonate or a salt thereof, polybutene succinic acid or a salt thereof, a polybutene sulfonic acid or a salt thereof, polyoxyethylene nonyl phenyl ether and the like.

If any additive or additives are used to dissolve, solubilize, or disperse the charge-transfer complex or complexes, such additive can be selected from the surfactants defined above. In such a case, the additive may be either the same surfactant used for stably dispersing the ferromagnetic particles or may be different from that used for the dispersion.

If it is desired to obtain a ferrofluid having high magnetization characteristics, it can be efficiently achieved by using the method of producing the ferrofluid previously proposed by the inventor's invention, Japanese Laid-Open Patent Publication No. Sho 58(1983)-174495.

According to this method, ferromagnetic particles and a selected surfactant or surfactants are added to an organic solvent or solvents having a low boiling point, to obtain an intermediate medium wherein ferromagnetic particles which have their surfaces coated with the surfactant are dispersed in the low boiling point organic solvent, such as, hexane or benzene or mixtures thereof. Next, the poorly dispersed particles are removed by centrifugal separation. Thereafter, the, thus, prepared intermediate medium is mixed together with a carrier liquid, and the admixed liquid is, then, heated to remove the low boiling point organic solvent by evaporation, or the fine particles are added with the carrier after the low boiling point organic solvent has been removed by evaporation to obtain a stable magnetic colloid solution of high density.

However, it is to be noted that, in producing the ferrofluid of the present invention, it is not always required to form the intermediatemedium. It is possible that ferromagnetic particles can be directly admixed with the liquid carrier, as is generally done.

Following, for purposes of illustration, are working examples of the electrically conductive ferrofluid hereof along with a description of the process of production thereof.

EXAMPLE I

In a suitable vessel, 6N of NaOH solution was added to 1 liter of an aqueous solution containing 1 mol each of ferrous sulfate and ferric sulfate to reach a pH 11 (to obtain magnetite colloids). Then, the admixture was heated at 60° C. for 30 minutes for aging. Thereafter, to the, thus, prepared magnetite-containing slurry while, being held at 60° C., was added 3N of HCl to adjust the pH to 5.5.

Thereafter, 50 grams of sodium oleate, an unsaturated fatty acid surfactant for dispersing the colloid particles, was added under agitation for 30 minutes and then held still. During this holding period, magnetite particles had coagulated and settled.

The supernatant was removed and the residual was washed with water. This operation was repeated several times to remove the electrolyte contained therein. After finishing the washing, the slurry was filtered, dehydrated and dried.

Then a suitable amount of hexane was added to the magnetite particles, which had become lyophilic by having adsorbed the hydrophobic group of the sodium oleate (—COO—), and the magnetite particles were dispersed in the solvent by sufficient agitation.

There was, thus, obtained an intermediate medium with ferromagnetic particles the surface of which had been coated with a surfactant being dispersed in a low boiling point solvent.

Then the intermediate medium thus obtained was subjected to centrifugal separation for 30 minutes under a gravity field of 8000 G. After large magnetite particles had been settled and separated, the supernatant was transferred to a rotary evaporator and held at a temperature of 90° C. to evaporate the hexane contained therein. The magnetite particles remaining in the evaporator flask were used as a dispersant for the ferrofluid of the present invention.

Thereafter, 6 grams of poly-α-olefin oil, 80 mg of pyrene as a conductivity imparting member acting as an electron donor for the charge-transfer complex, 200 mg of iodine as an electron acceptor, and 0.5 g of polyoxyethylene nonyl phenyl ether were dissolved in benzene.

The prepared benzene solution was transferred to a rotary evaporator, and the benzene was evaporated by holding it at a temperature os 90° C. The residue oil thus obtained is the carrier imparted with electrical conductivity.

Three grams of previously prepared fine particles of magnetite were redispersed in hexane and after being added to the conductive carrier, the resulting admixture solution was transferredto a rotary evaporator, and was held there at 90° C. to evaporate the hexane. The remaining substance was a conductive ferrofluid.

Since the ferrofluid thus obtained had already been removed of large size magnetic particles by having gone through the intermediate medium it proved to be very stable.

The resistance of an annular ring (ferrofluid sealing) proved to be a very low value of 6MΩ, when the obtained ferrofluid was formed as an annular ring (inside diameter: 7 mm, outside diameter: 7.4 mm, thickness: 0.7 mm) and its resistance was measured, the ring having sufficient conductivity for preventing a charge from building-up.

EXAMPLE II

Two grams of tetrathiafulvalene (TTF) and 2 grams of 7,7,8,8-tetracyanoquinodimethane (TCNQ) were added to acetonitrile solvent with sufficient agitation. The admixture was, then, transferred to a rotary evaporator and held there at 90° C. to evaporate the acetonitrile. After the evaporation, the TTF-TCNQ complex remaining in the measuring flask was used as a charge-transfer complex.

Meanwhile, 5 grams of magnetite particles obtained as a dispersant, in the manner described in ExampleI, was dispersed in hexane, to which 10 grams of poly-α-olefin oil was added with agitation. Thereafter the thus obtained mixture was placed in a rotary evaporator and held there at 90° C. to evaporate the remained hexane.

The, thus, obtained ferrofluid and 0.45 grams of the TTF-TCNQ complex were subjected to grinding while being mixed. The ferrofluid, after having been mixed and pulverized, proved to have very good stability.

The resistance of an annular ring (ferrofluid sealing) proved to be a very low value of 7MΩ, when the obtained ferrofluid was formed as an annular ring (inside diameter: 7 mm, outside diameter: 7.4 mm, thickness: 0.7 mm) and its resistance was measured, the ring having sufficient conductivity for preventing charge from building-up.

The ferrofluid composition of the present invention can be freely adjustable by changing the amount of the charge-transfer complex. Thus, it is possible to raise or lower the electric resistance, if such adjustment is required.

Moreover, the method of this invention is not limited to those disclosed in the foregoing examples. For instance, the intermediate medium may be prepared as such one that contains not only the ferromagnetic particles and the dispersant thereof but also the charge-transfer complex and the surfactant for dissolving, solubiliting or dispersing the aforesaid complex for shifting the charge. Then, the medium is removed of large ferromagnetic particles and, thereafter, mixed with a carrier, such as an organic dispersing solvent and, then, heated to remove the low boiling point solvent.

FIG. 1 schematically shows the structure of the ferrofluid of the present invention. That is to say, the ferromagnetic particle 1, the surface of which having been covered by the hydrophobic group 2 of a surfactant, (in this case oleinic acid) similar to the prior art one, and being lyophilic, is floating and is stably dispersed in the poly-α-olefin oil carrier 3.

Differing from the prior art composition, a large amount of fine particles of charge-transfer complex 4 are floating in the composition.

These particles of charge-transfer complex 4, themselves, are dispersed in the carrier 3, being dispersed by the aid of polyoxyethylenenonylphenylether, or being dissolved or rendered soluble in micelles formed by the surfactant. Therefore, they are floating in a manner more readily movable as compared with the magnetic particle 1 covered by the surfactant.

Accordingly, the built-up charge can be readily transferred within the carrier through the charge-transfer complex 4 and, then, removed.

According to the present invention, since the particles of charge-transfer complex(es) are dissolved, solubilized or dispersed in the carrier imparting electrical conductivity to the ferrofluid wherein fine particles of ferromagnetic material are dispersed in a liquid carrier in a very stable manner, the ferrofluid of this invention can readily transfer the built-up charge and displays high ability to prevent any undesirable charge from building up.

In addition, the conductivity obtainable according to the present invention is not restricted by the extent of saturation magnetization, but it can be freely adjusted by controlling the amount of added charge-transfer complex.

Since the method of the present invention can be carried out by a single additional step to add the charge-transfer complex to the liquid carrier, the ferrofluid product hereof can be made readily and with reduced cost.

Having, thus, described the invention, what is claimed is:

1. A conductive ferrofluid composition which consists essentially of:

an organic solvent as a liquid carrier;

at least one charge—transfer complex for imparting conductivity to the composition, the complex including at least one electron donor and at least one electron acceptor, the electron donor being different from the electron acceptor;

fine particles of ferromagnetic material, the diameter of the particles lying within the range of 20 to 500 Angstroms; and an additive for stably dispersing said fine particles of ferromagnetic material in said organic solvent, selected from the group consisting of anionic surfactants having at least one polar group, and nonionic surfactants.

2. A conductive ferrofluid composition as claimed in claim 1, wherein said complex is stably present in said liquid carrier.

3. The composition of claim 1 wherein said ferromagnetic particles are distributed in said organic solvent within a range of 1 to 70% by volumetric ratio.

4. The composition of claim 1, wherein the organic solvent used as a carrier includes at least one solvent selected from the group consisting of:

mineral oils, synthetic oils, ethers, esters, silicone oils, poly-olefin oils, alkylnaphthalene oils, and mixtures thereof.

5. The composition of claim 1, wherein the electron donor is selected from the group consisting of: violanthrone, pyrene, pyridazine, benzidine, tetrathiafulvalene, N-methylphenazine, and hexamethylene tetraselenofulvalene, and mixtures thereof.

6. The composition of claim 1, wherein the electron acceptor is selected from the group consisting of: iodine, 7,7,8,8-tetracyanoquinodimethane, 2,4,6-tricyanotriazine, and mixtures thereof.

7. The composition of claim 1, wherein said electron donor is selected from the group consisting of aromatic compounds, heteroaromatic compounds, amines and mixtures thereof; and said anionic surfactants have at least 10 carbon atoms and at least one polar group selected from the group consisting of a carboxyl group (—COOH), an amino group (—$NH_2$), a hydroxyl group (—OH), a sulfone group (—$SO_3H$ a phosphate ester group (—$OPO_3H$), and mixtures thereof.

8. The composition of claim 1, wherein the polar group is selected from the group consisting of: a carboxyl group, a hydroxyl group, a sulfone group, an amino group, a phosphate ester group, and mixtures thereof.

9. The composition of claim 1, wherein the nonionic surfactant is polyoxyethylene nonyl phenyl ether.

10. The composition of claim 1, wherein the anionic surfactant is an unsaturated fatty acid or a salt thereof selected from the group consisting of: a petroleum sulfonate, a salt of a petroleum sulfonate, a synthetic sulfonate, a salt of a synthetic sulfonate, polybutene succinic acid, a salt of polybutene succinic acid, a polybutene sulfonic acid, a salt of a polybutene sulfonic acid, and mixtures thereof.

11. The composition of claim 1, wherein the organic solvent includes an ether selected from the group consisting of polyphenylethers, alkylpolyphenyl ethers and mixtures thereof.

12. In an electrically conductive ferrofluid composition of the type comprising a solvent as a liqud carrier; a conductor for imparting conductivity to the composition; fine particles of ferromagnetic material; and an additive for stably dispersing the fine particles of ferromagnetic material in the solvent;

the improvement which comprises:

at least one change-transfer complex containing both an electron donor and an electron acceptor different from the electron donor.

13. The composition of claim 12 wherein the electron donor is selected from the group consisting of: violanthrone, pyrene, pyridazine, benzidine, tetrathiafulvalene, N-methylphenazine, hexamethylene tetraselenofulvalene, and mixtures thereof.

14. The composition of claim 12 wherein the electron acceptor is selected from the group consisting of: iodine, 7,7,8,8-tetracyanoquinodimethane, 2,4,6-tricyanotriazine, and mixtures thereof.

15. The composition of claim 1, wherein the molar ratio of said donor to said acceptor is in the range from 1:01 to 1:10 by weight.

16. The composition of claim 4 wherein said molar ratio of said donor to said acceptor is 1:1 or 1:4.

17. The composition of claim 1, wherein the upper ratio of said charge-transfer complex to said ferrofluid is about 50% by weight, of the total composition.

18. The composition of claim 16, wherein the amount of said charge-transfer complex is about 3.0% or 3.1% by weight of the total composition.

* * * * *